US006059007A

United States Patent [19]

Tomita

[11] Patent Number: 6,059,007

[45] **Date of Patent: *May 9, 2000**

[54] ROLLING SCREEN

[76] Inventor: Katsuaki Tomita, 76, Shimoyakiri, Matsudo-shi, Chiba-ken 271, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,499

[22] Filed: Apr. 9, 1997

[30] Foreign Application Priority Data

Apr. 11, 1996 [JP] Japan ..... 8-112992

[51] Int. Cl.[7] ..... A47G 5/02

[52] U.S. Cl. ..... 160/242; 160/264; 160/368.1; 160/273.1; 160/99

[58] Field of Search ..... 160/27, 28, 99, 160/100, 242, 368.1, 264, 243, 120, 122, 246, 260, DIG. 7

[56] References Cited

U.S. PATENT DOCUMENTS

| | | | |
|---|---|---|---|
| 1,184,305 | 5/1916 | Benko | 160/264 X |
| 1,217,338 | 2/1917 | Okamuro | 160/27 X |
| 1,344,758 | 6/1920 | Donnelly | 160/122 |
| 1,459,155 | 6/1923 | Ioor | 160/264 X |
| 1,849,371 | 3/1932 | Gronbech | 160/27 X |
| 1,996,108 | 4/1935 | Herr | 160/27 X |
| 2,012,878 | 8/1935 | Kish | 160/122 |
| 2,200,481 | 5/1940 | Thexton | 160/264 |
| 2,323,295 | 7/1943 | Brewer | 160/99 |
| 2,514,438 | 7/1950 | Bardega | 160/99 X |
| 2,711,788 | 6/1955 | Covi | 160/122 X |
| 3,017,927 | 1/1962 | Demko | 160/DIG. 7 |
| 3,753,458 | 8/1973 | Lazarek | 160/368.1 X |
| 3,882,921 | 5/1975 | Sandall | 160/242 X |
| 4,249,589 | 2/1981 | Loeb | 160/368.1 |
| 4,359,081 | 11/1982 | Brower | 160/243 |
| 4,419,982 | 12/1983 | Eckels | 160/368.1 X |
| 4,436,137 | 3/1984 | Charles | 160/242 |
| 4,867,222 | 9/1989 | Roman et al. | 160/368.1 X |
| 5,429,171 | 7/1995 | Hamilton | 160/122 X |
| 5,680,893 | 10/1997 | Neer | 160/DIG. 7 |
| 5,850,864 | 12/1998 | Decker | 160/368.1 |

FOREIGN PATENT DOCUMENTS

| | | | |
|---|---|---|---|
| 11040 | 3/1936 | Australia | 160/28 |

*Primary Examiner*—Blair M. Johnson
*Attorney, Agent, or Firm*—Evenson, McKeown, Edwards & Lenahan, P.L.L.C.

[57] ABSTRACT

A rolling screen comprises a screen case, a take-up shaft arranged rotatably about a central axis thereof within the screen case, and a screen wound on said take-up shaft so that the screen can be wound out of said screen case. The take-up shaft is normally biased in a screen-winding direction by a torsion spring. An outer peripheral surface of the screen wound on the take-up shaft is always maintained in contact with an inner wall of the screen case, said inner wall being located in a direction of winding-out of the screen, by pulling force applied to the screen upon extension of the screen or resilient force of a pressing spring when the screen is wound out or wound in.

16 Claims, 8 Drawing Sheets

ROLLING SCREEN

BACKGROUND OF THE INVENTION a) Field of the Invention

This invention relates to a rolling screen with a screen such as an insect net or a sunshade cloth stored within a screen case. The screen is wound on a take-up shaft rotatably held within the screen case. Accordingly, the screen can be automatically arranged extending over an opening of a building or the like while winding it out of the screen case. When the screen becomes no longer needed, it can be wound back into the screen case by taking it up on the take-up shaft.

b) Description of the Related Art

Conventional rolling screens include those having a screen case arranged inside a window frame or the like. The screen case is provided with a hollow take-up shaft rotatably arranged inside the screen case. A screen, such as an insect net or a sunshade cloth, is wound on the take-up shaft so that the screen is stored within the screen case. When the screen is needed, the screen is wound out of the screen case so that it is automatically arranged extending over an opening of the window or the like. When the screen becomes no longer needed, it can be wound back into the screen case by taking it up on the take-up shaft.

Upon winding out the screen to arrange the same to extend over the opening, it is necessary to permit its smooth planar arrangement without causing a wound-out portion of the screen to wave (in other words, to undergo a so-called flaring phenomenon). When the screen is wound out and is arranged extending over the opening, pulling force is applied to the take-up shaft via the screen. The take-up shaft is therefore required to have strength sufficient to withstand such pulling force, so that the take-up shaft is protected from flexion and deformation to avoid occurrence of noise from the take-up shaft and also to permit smooth arrangement of the screen. Accordingly, it has heretofore been the practice to use, as a take-up shaft, a pipe having a large outer diameter. It has also been the practice to leave the arranged screen free at upper and lower edges thereof.

For the avoidance of the above-mentioned potential problem that the take-up shaft may be flexed and deformed by pulling force applied via the screen upon winding out the screen and during its use, and the take-up shaft may hence produce noise and/or prevent smooth winding-out and arrangement of the screen, it is essential to employ, as the take-up shaft, a pipe having strength sufficient to withstand such pulling force, i.e., having an outer diameter large enough to withstand such pulling force.

When a screen such as an insect screen is arranged extending over an opening of a building, the thus-arranged screen is exposed to wind pressure. An associated take-up shaft is therefore pulled by the screen, so that the take-up shaft may be flexed and deformed. This may lead to an inconvenience that the screen may be caused to flare at a central part thereof. As the take-up shaft for taking up and storing the screen, a pipe having an outer diameter of 20 mm or greater is in general therefore used. A screen case having large external dimensions is therefore required for the accommodation of the take-up shaft. This leads to a problem that the screen case may not be adequately arranged within a small depth of a frame of an opening of a building, for example, within a small depth of inner casing of an opening of a door or window. Especially in a construction where a rolling wire screen, which is used to prevent entry of insects, is received in a window end stile of a double sliding sash, namely, in a construction where a window end stile is provided with a channel of a square U-section which is open on a window end side of the stile, a rolled screen is stored in the channel, and a sliding glass sash is horizontally pulled or opened to cause the screen to extend over the opening, the depth of a window end stile of the double sliding sash is usually as small as 20 to 25 mm or so. As a corollary to this, the outer diameter of the take-up shaft of this rolling wire screen must be as small as 10 mm or so. The take-up shaft cannot therefore be provided with sufficient strength, possibly resulting in a substantial deformation due to flexion caused upon winding out the screen or during use of the screen. This deformation in turn results in waving of the screen, thereby making it impossible to fully achieve the object, that is, the prevention of entry of insects. In particular, as the length of a take-up shaft of a small outer diameter becomes greater, the take-up shaft tends to become more liable to arching before transmission of sufficient rotating force to the take-up shaft upon winding out the screen. It may hence become no longer possible to wind out the screen in some instances.

In the case of a horizontal rolling wire screen that a net is caused to extend in a horizontal direction over an opening of a building, a wound-out portion of the net is generally left free at its upper and lower edges. Openings therefore tend to occur between the upper and lower edges of the net and the corresponding upper and lower frames of the opening of the building, leading to a problem that the wire screen cannot fully prevent insects from entering the building. Moreover, the upper and lower edges of the net are more susceptible to stretching and slacking than a central part of the net. This results in problems that the net may be stored in a folded state upon taking it up on a take-up shaft, and the net yarns are prone to loosening at the upper and lower edges, leading to breakage of the net. As a countermeasure to this potential problem, it has therefore been proposed and practiced to sew discrete tapes such as of aluminum foil on and along the upper and lower edges of the net for their reinforcement. The sewing of tapes such as of aluminum foil or the like however results in a greater thickness at both the upper and lower edges of the net. As a result, the take-up shaft with the net wound thereon has a greater outer diameter, leading to a problem that a greater screen case must be used for the accommodation of the take-up shaft and the net wound thereon.

On the other hand, in the case of a vertical rolling wire screen where a net is caused to extend in a vertical direction, reinforcing tapes such as of aluminum foils are generally sewn on and along opposite vertical side edges of the net. The net is therefore thicker at the vertical side edges than the remaining part thereof, whereby stepped portions are formed along the vertical side edges. The reinforced vertical side edges are fitted in guide slits, specifically in lipped opposite vertical side guide rails of a square U-section, so that the reinforced vertical side edges are held slidably up and down in the corresponding lipped opposite vertical side guide rails. The opposite vertical side edges of the net can therefore be maintained within the corresponding guide rails when the net is caused to extend in a vertical direction. Friction is however developed between the reinforced opposite vertical side edges of the net and the corresponding guide rails when the net is caused to extend or is taken up. Due to this friction, greater operating force is required upon causing the net to extend or retract and especially, significant operating force is required upon causing the net to extend downwards. The above friction also causes sliding noise upon operating the net in a vertical direction. Further, when the net is exposed to external pressure and substantially large load is applied to the opposite vertical side edges of the net, the opposite vertical side edges of the net may slip out of the guide rails. If this happens, it is very difficult to repair the vertical rolling wire screen. Its repair must hence be done by a professional repairman. This is certainly very cumbersome for the user.

SUMMARY OF THE INVENTION

An object of the present invention is therefore to improve the above-described drawbacks of the conventional art, and specifically to reduce the dimensions of a screen case, in which a take-up shaft with a rolling screen wound thereon is accommodated, for providing the screen case with wider applicability and higher operability as a final product and also to fully maintain the screen taut for the prevention of entry of insects and the like during its use in an extended state.

In one aspect of the present invention, there is accordingly provided a rolling screen comprising:

a screen case, a take-up shaft arranged rotatably about a central axis thereof within the screen case, said take-up shaft being normally biased in a screen-winding direction by a torsion spring, and a screen wound on the take-up shaft so that the screen can be wound out of the screen case;

wherein an outer peripheral surface of the screen wound on the take-up shaft is always maintained in contact with an inner wall of the screen case, said inner wall being located in a direction of winding-out of the screen, by pulling force applied to the screen upon extension of the screen or resilient force of a pressing spring when the screen is wound out or wound in.

Even if the take-up shaft begins to flex by pulling force applied to the take-up shaft upon extension of the screen, the pulling force applied to the take-up shaft is supported by the inner wall of the screen case. The take-up shaft is therefore protected from deformation which would otherwise occur by the pulling force. It is therefore no longer necessary to use a take-up shaft of which the diameter has been increased to provide the take-up shaft with sufficient strength. The screen case itself can therefore be constructed compactly. Incidentally, the rolling screen according to this invention can be arranged between guide rails fixed on upper and lower frames of a sash. As an alternative, the rolling screen can also be arranged between stiles of a sliding sash.

In another aspect of the present invention, there is also provided a rolling screen comprising:

a screen case, a take-up shaft arranged rotatably about a central axis thereof within the screen case, and a flexible net wound as a screen on the take-up shaft so that the flexible net can be wound out of the screen case;

wherein the flexible net has been reinforced at a predetermined width in opposite side edge portions thereof, which extend at right angles relative to the take-up shaft, by coating the flexible net in the opposite side portions thereof with a liquid-form synthetic resin to form thin films and then hardening the thin films.

Owing to the above-described construction, the opposite side edge portions of the flexible net, said opposite side edge portions being lowest in strength, can be improved in strength. It is therefore possible to prevent breakage of the flexible net and also to avoid slacking of the flexible net while the flexible net is used in an extended state.

In a further aspect of the present invention, there is also provided a rolling screen comprising:

a screen case, a take-up shaft arranged rotatably about a central axis thereof within the screen case, a flexible net wound as a screen on the take-up shaft so that the flexible net can be wound out of the screen case;

guide rails arranged in parallel with each other along casings, which are disposed in a paired opposing relationship across an opening of a building, respectively so that running of the screen case with the take-up shaft accommodated therein is guided at opposite end portions of the screen case by the guide rails, and fasteners arranged on the guide rails, respectively;

wherein, when the screen case is caused to move in a direction along the guide rails, the flexible net is arranged extending over the opening without a slack by causing a wound-out portion of the flexible net to detachably engage the fasteners at opposite side edge portions of the flexible net and, when the screen case is caused to move in an opposite direction along the guide rails, the flexible net is wound into the screen case by taking up the flexible net on the take-up shaft while allowing the opposite side edge portions of the wound-out portion of the flexible net to disengage from the fasteners.

Owing to the above-described construction, even when the flexible net is exposed to wind pressure, the wind pressure itself can be supported by the guide rails via the engagement between the fasteners and the flexible net. The flexible net can therefore be prevented from flaring at a central part of the flexible net, so that the flexible net can be used in an extended state without a slack.

In a still further aspect of the present invention, there is also provided a rolling screen comprising:

guide rails arranged in parallel with each other along casings, which are disposed in a paired opposing relationship across an opening of a building, respectively, two screen cases arranged so that the two screen cases are guided at opposite ends thereof by the guide rails, take-up shafts arranged rotatably within the screen cases, respectively, one of the take-up shafts carrying a sunshade screen wound thereon and the other one of the take-up shafts carrying a flexible net wound thereon, and a selector arranged between the screen cases so that the screen cases can be selectively connected together or disconnected from each other;

whereby one of the sunshade screen and the flexible net can be arranged extending over the opening as desired.

Owing to the above-described construction, the two screen cases can be slidably arranged in an efficient fashion, thereby providing the rolling screen with very wide applicability as a final product. Either the sunshade screen or the flexible net can be caused to extend over the opening of the building as needed.

DETAILED DESCRIPTION OF THE INVENTION AND PREFERRED EMBODIMENTS

Figure 1:
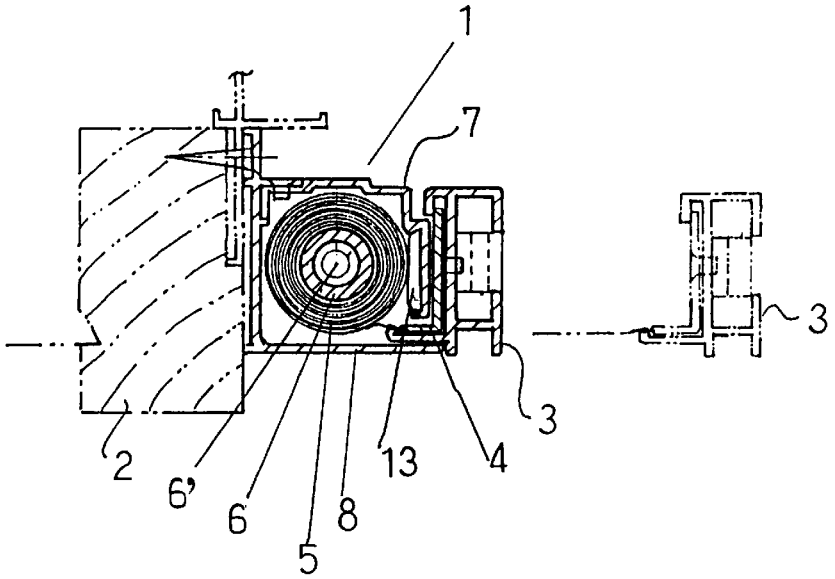
FIG. 1 is a fragmentary horizontal cross-sectional view of an upright rolling screen according to a first embodiment of the present invention.

The present invention will hereinafter be described in more detail on the basis of the embodiments illustrated in the drawings.

Referring first to FIG. 1, the upright rolling screen according to the first embodiment of the present invention is designated at numeral 1. This upright rolling screen 1 is installed within the depth of the interior wood casing 2 of the sash. A flexible screen 5 such as an insect screen or sunshade cloth made, for example, of a polyester can be caused to extend by drawing the upright rolling screen 1 in a horizontal direction. By detachable engagement of a metal fitting with the interior wood casing 2, the screen 5 can be held in the extended state (see FIG. 2). By double-tack tapes or the like, for example, the screen 5 is fixedly joined at one end thereof with a take-up shaft 6—whose outer diameter is as small as half the diameter of a conventional take-up shaft, that is, about 10 mm or so—and at an opposite end thereof with an angle 4 which is brought into engagement with a movable upright member 3. The screen 5 is wound on the take-up shaft 6 in such a way that the screen 5 can be paid out and taken up as desired. A screen case 8 is formed in a channel shape so that the screen case 8, together with a case cover 7, can accommodate therein the take-up shaft 6 and the screen 5 wound thereon.

To permit winding of the screen 5 on and around the take-up shaft 6 by biasing force of a torsion spring (not illustrated), the take-up shaft 6 is supported rotatably about an axis 6' by shaft-supporting brackets 9 within the screen case 8. The shaft-supporting brackets 9 are loosely fitted in guide grooves 11 of brackets 10 fixedly arranged on upper and lower edges of the screen case 8, respectively. Further, the take-up shaft 6 is arranged movably in the guide grooves 11 of the brackets 10 so that by resilient force of feedback springs 12 integrally secured on the shaft-supporting brackets 9 or by pulling force applied to the screen 5 upon its winding-out, an outer peripheral surface of the screen 5 wound on the take-up shaft 6 is always maintained in contact with support members 13 arranged at constant intervals on an inner wall of the screen case 8, said inner wall being located in a direction of winding-out of the screen 5.

Figure 2:
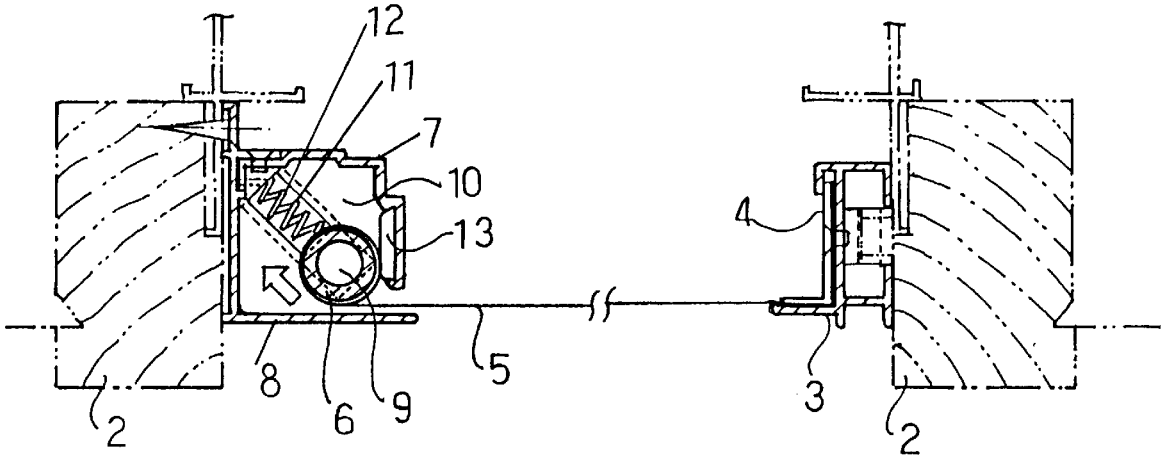
FIG. 2 is a horizontal cross-sectional view of the upright rolling screen according to the first embodiment of the present invention as installed within a depth of an interior wood casing of a sash.

Owing to the provision of the above-described construction, the rolling screen 1 according to the first embodiment of the present invention can be operated as will be described below. To cause the screen 5 to extend out of the screen case 8, the movable upright member 3 is horizontally drawn and the metal fitting is brought into engagement with the wood casing as shown in FIG. 2. As the screen 5 wound on the take-up shaft 6 is paid out and the outer diameter of the take-up shaft 6 including the screen 5 wound thereon becomes smaller, the take-up shaft 6 progressively moves in a lower right direction as viewed in FIG. 2 while pulling the feedback springs 12 under progressively increasing force. Therefore the outer peripheral surface of the screen 5 wound on the take-up shaft 6 can be always maintained in contact with the support members 13 arranged at constant intervals on the inner wall of the screen case 8, said inner wall being located in the direction of winding-out of the screen 5. Namely, as the screen 5 is paid out, the take-up shaft 6 is caused to move along the guide grooves 11 of the brackets 10 in the winding-out direction of the screen 5. Accordingly, the take-up shaft 6 rotates while the outer peripheral surface of the screen 5 wound on the take-up shaft 6 is always maintained in contact with the support members 13. As a consequence, even if the take-up shaft 6 begins to flex under pulling force applied thereto when the screen 5 is wound out, the pulling force applied on the take-up shaft 6 is borne by the support members 13. The take-up shaft 6 is therefore protected from deformation which may otherwise occur by the pulling force. It is therefore no longer required to use, as the take-up shaft 6, a take-up shaft having an increased diameter in order to provide strength sufficient to prevent deformation of the take-up shaft 6 upon arrangement of the screen 5 in an extended state. This makes it possible to construct the screen case 8 itself compactly.

Upon storing back the extended screen 5 into the screen case 8, on the other hand, the fixed engagement of the movable upright member 3 is released. As a result, the extended screen 5 is taken up by the biasing force of the torsion spring (not shown) arranged on the take-up shaft 6 and is hence stored back into the screen case 8. As the extended screen 5 is wound back onto the take-up shaft 6, the outer diameter of the take-up shaft 6, including the screen 5 wound thereon, becomes greater. Owing to the arrangement of the feedback springs 12 attached to the take-up shaft 6, the take-up shaft 6 is always under pulling-back force which is applied toward an upper left side as viewed in FIG. 2. As the extended screen 5 is wound back onto the take-up shaft 6, the shaft-supporting brackets 9 with the take-up shaft 6 rotatably supported thereon are allowed to move back toward the upper left side as viewed in FIG. 2. Accordingly, the screen 5 is wound back onto the take-up shaft 6 while always being held between the take-up shaft 6 and the support members 13. This can eliminate such an inconvenience that the screen 5 may be wound back in a folded state.

Upon paying out the screen (5) from the take-up shaft 6 inside the screen case 8 or winding it back onto the take-up shaft 6, the screen 5 itself is always held between the take-up shaft 6 and entire surfaces of the support members 13 arranged at the constant intervals on the inner wall of the screen case 8. Friction is hence always developed between the screen 5 and the support members 13, leading to a potential problem that smooth rotation of the take-up shaft 6 may be hampered upon paying out or winding back the screen 5. Production of the support members 13 with a low-friction material such as a synthetic resin results in smaller frictional resistance upon paying out and winding back the screen 5, so that smooth rotation of the take-up shaft 6 can be assured. For the simplification of the structure of the screen case 8 itself, the support members 13 may be eliminated and instead, the screen 5 is supported in contact with an entire surface of an edge portion of the case cover 71 although the frictional resistance with the screen 5 somewhat increases.

Figure 3:
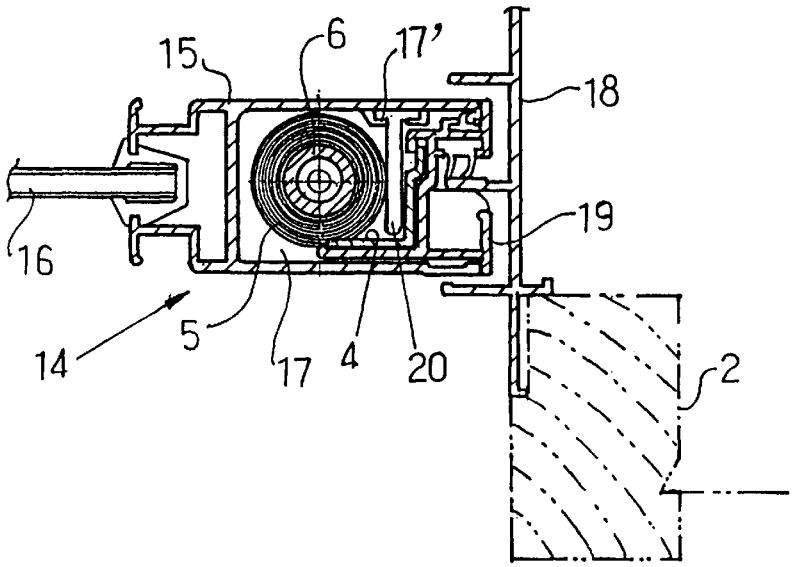
FIG. 3 is a fragmentary horizontal cross-sectional view of the upright rolling screen according to the first embodiment of the present invention as installed on a window end stile of a sliding glass sash in a double sliding sash.
Figure 4:
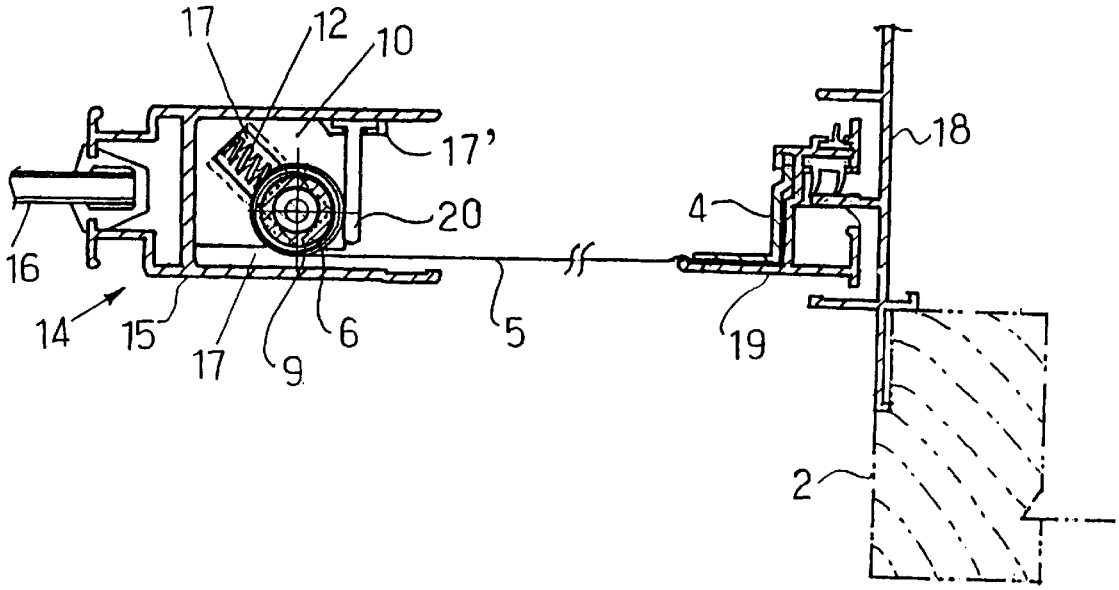
FIG. 4 is a horizontal cross-sectional view of the upright rolling screen of FIG. 3 in a used state.

Reference is next had to FIG. 3, where the rolling screen 1 according to the first embodiment of the present invention is accommodated within the window end stile 15 of the sliding glass sash 14 in the double sliding sash. The window end stile 15 with a pane fitted therein has an open channel pocket 17 on a side of a jamb 18, and a cover member 19 disposed in engagement with the jamb 18 is engageable with the window end stile 15 so that the open channel pocket 17 can be closed by the cover member 19. The angle 4 to which the one end of the screen 5 is fixedly joined is secured on the cover member 19. The take-up shaft 6 with the screen 5 wound thereon is accommodated within the open channel pocket 17 of the window end stile 15. This take-up shaft 6 is rotatably supported on the brackets 9, which are loosely fitted in the guide grooves 11 of the brackets 10 fixed on the upper and lower ends of the window end stile 15, respectively. Along the guide grooves 11 of the fixed bracket 10, the take-up shaft 6 is movable by pulling force applied upon arrangement of the screen 5 in an extended state and the resilience of the feedback springs 12 attached to the take-up shaft 6. In addition, a support member 20 made of a synthetic resin and having a T shape in cross-section is inserted at a basal end thereof in a holding groove 17' formed in an inner wall of the open channel pocket 17 of the window end stile 15, whereby an outer peripheral surface of the screen 5 wound on the take-up shaft 6 is always maintained in contact with the support member 20.

As the first embodiment of the present invention is provided with the above-described construction, the outer peripheral surface of the screen 5 wound on the take-up shaft 6 is supported by the entire surface of the support member 20 even when the outer diameter of the take-up shaft 6, including the screen 5 wound thereon, is reduced as a result of drawing and opening of the window end stile 15 in a horizontal direction. The take-up shaft 6 is therefore prevented from flexion. This assures smooth rotation of the take-up shaft 6 upon paying out or winding back the screen 5.

Incidentally, the depth of a sliding glass sash mounted on two rails in a double sliding sash is generally limited to 25 mm or so at the maximum. Further, the width of an opening of the sliding glass sash 14 ranges from 800 to 850 mm in general, and a door opening is considered to have a similar width. When the take-up shaft 6 is accommodated within the window end stile of such a small depth, the outer diameter of the take-up shaft 6—including a screen, such as a net, of a width corresponding to the sliding glass window—is limited to 20 to 22 mm at the maximum. To surely provide a flexible net, such as that made of a polyester, with practically sufficient tensile strength, the net thickness is preferably 0.3 mm or greater. If the net thickness is set at 0.35 mm, the outer diameter of the take-up shaft 6, including the screen 5 wound thereon, is set at 22 mm and the extended width of the screen 5 is set at about 800 mm, there is no choice other than reducing the outer diameter of the take-up shaft 6 to a level as small as 11 mm. When this take-up shaft 6 is used in a length as great as the height of a door and is supported only at the opposite ends thereof, this outer diameter is too small to withstand bending deformation of the take-up shaft 6 through flexion even when a thick-wall stainless pipe is used. Even when the outer diameter of the take-up shaft 6 itself is reduced, the construction of the first embodiment according to the present invention however makes it possible to prevent deformation of the take-up shaft 6 which would otherwise take place by pulling force applied upon arrangement of the screen 5 in an extended state. The first embodiment of the present invention therefore has the economy that a PVC pipe, a thinwalled aluminum pipe of the like can be used as the take-up shaft 6. Moreover, the screen 5 can be uniformly arranged extending tautly without flaring at a central part thereof.

Figure 5:
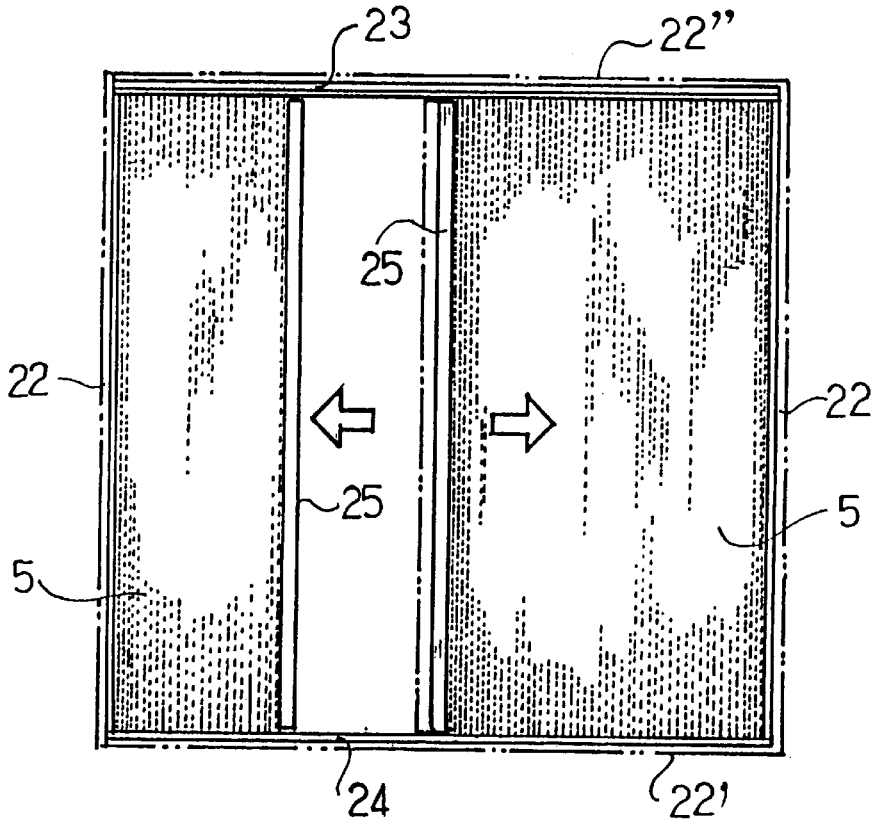
FIG. 5 is an elevation view of a double-sliding rolling screen according to a second embodiment of the present invention as arranged on an interior side of a sash.
Figure 6:
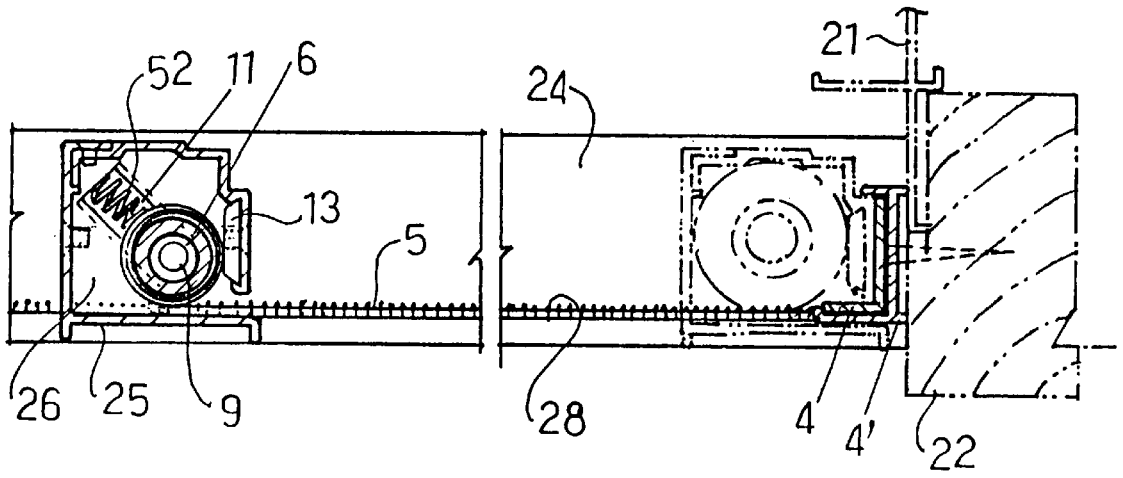
FIG. 6 is a fragmentary horizontal cross-sectional view of the double-sliding rolling screen of FIG. 5.
Figure 7:
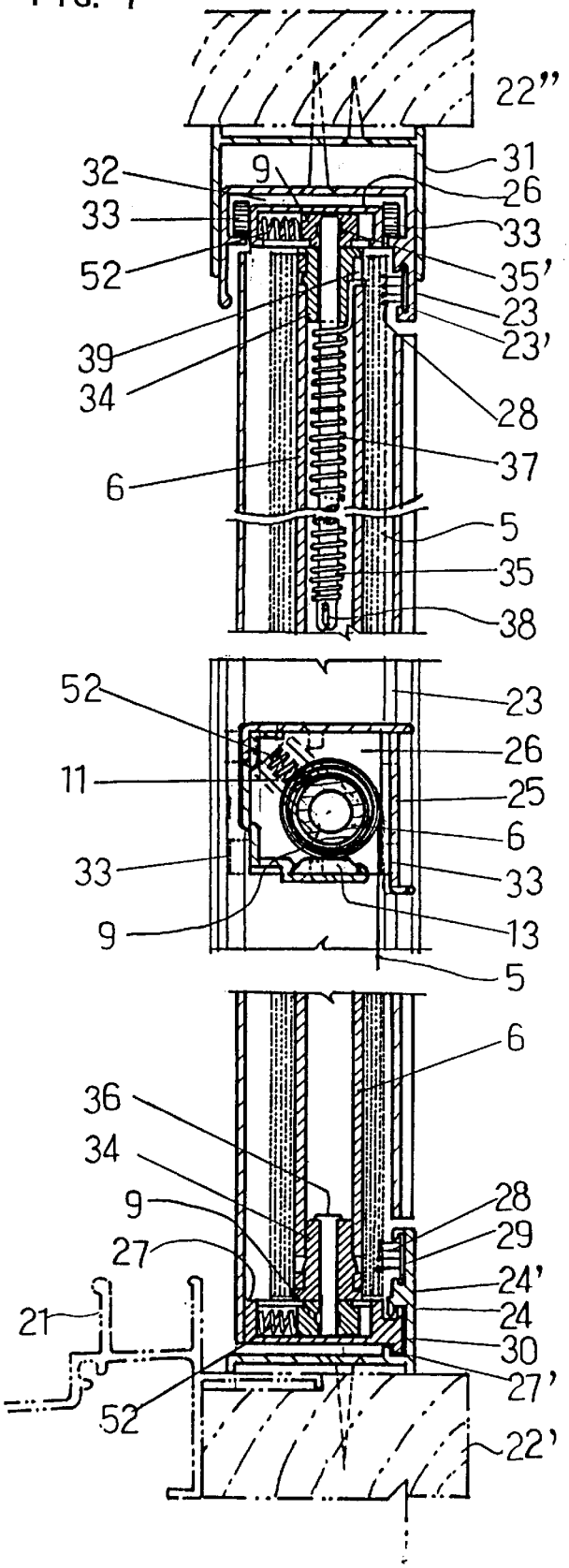
FIG. 7 is a fragmentary vertical cross-sectional view of the double-sliding rolling screen of FIG. 5.

Referring next to FIGS. 5 to 7, the rolling screen 1 according to the second embodiment of the present invention will be described. The rolling screen 1 is a double-sliding rolling screen, which is provided with upper and lower guide rails 23,24 arranged between upper edges of jambs 22,22 and between lower edges of the jams 22,22, respectively and is arranged on an interior side of a sash 21. Described specifically, an angle 4 to which a screen 5 such as a net is fixedly joined at one end thereof with a double-tack tape is fixed on one of the jambs 22,22 via a fixing member 4'. A screen case 25 in which a take-up shaft 6 with the screen 5 wound thereon is accommodated is loosely fitted for sliding movement between the upper and lower guide rails 23,24 via brackets 26,27 fixed on upper and lower end portions of the screen case 25. By causing the screen case 25 to slide leftwards or rightwards along the guide rails 23,24, the screen 5 is arranged in an extended state or is taken up.

Inside the screen case 25, the take-up shaft 6 is arranged rotatably about an axis 6' (see FIG. 1) with upper and lower ends of said take-up shaft 6 being rotatably supported on shaft-supporting brackets 9. The take-up shaft 6 winds up the screen 5 thereon by biasing force of a torsion spring 37. The shaft-supporting brackets 9 are supported in guide grooves 11 of brackets 26,27 fixed on the upper and lower ends of the screen case 25, respectively. Via these shaft-supporting brackets 9, the take-up shaft 6 is rotatably supported so that by pulling force applied upon arrangement of the screen 5 in an extended state or by resilient force of helical springs 52, which are attached to the take-up shaft 6, toward support members 13, an outer peripheral surface of the screen 5 wound on the take-up shaft 6 is always maintained in contact with the support members 13. The support members 13 are arranged at constant intervals on an inner wall of the screen case 25, said inner wall being located in a direction in which the screen 5 is paid out. As the screen 5 wound on the take-up shaft 6, a flexible net is used to prevent entry of insects and the like. To guide horizontal running of the screen case 25 at the upper and lower end portions of the screen case 25 while maintaining the screen case 25 in an upright position, the upper and lower guide rails 23,24 are horizontally arranged in an opposed parallel relationship. Fasteners 28 are arranged on these horizontal upper and lower guide rails 23,24, respectively. As the screen case 25 is caused to slide leftwards or rightwards while being guided by the horizontal, upper and lower guide rails 23,24, the screen 5 wound out of the screen case 25 is brought at upper and lower edge portions thereof into detachable engagement with the corresponding fasteners 28 so that the screen 5 can be arranged in an extended state without any slack.

According to the vertical cross-sectional view shown in FIG. 7, the lower guide rail 24 fixed on a lower wood casing 22' has an L-shaped section. Two lipped channels 29,30 are formed on an exterior side of an interior-side upright wall 24' of the lower guide rail 24. The fastener 28 is arranged in the channel 29, while a T-shaped section flange 27' of the bracket 27 fixed on the lower end of the screen case 25 is slidably fitted in the channel 30. On the other hand, the upper guide rail 23 fixed on an upper wood casing 22" is fitted in a height adjuster frame 31 of an inverted square U-shaped section movably up and down so that the upper guide rail 23 is horizontally fixed while permitting its height adjustment. The upper guide rail 23 itself has an inverted square U-shaped section and is internally provided with a lipped guide channel of an inverted square U-section. The fixed bracket 26 is loosely fitted in the guide channel 32 so that wheels 33 rotatably secured on opposite side walls of the fixed bracket 26 are allowed to run. Further, a channel 23' is formed on an exterior side of an interior-side pendant wall of the upper guide rail 23. The fastener 28 is fixedly fitted in the channel 23'. Flanged hat sleeves 34 are force-fitted on upper and lower end portions of the take-up shaft 6 on which the screen 5 is wound. These sleeves 34 are rotatably supported on shafts 35,36, respectively. On outer peripheral walls of end portions of the shafts 35,36, relative-rotation-preventing ribs 35',35' are arranged. These end portions with the ribs 35',35' formed thereon are fixedly force-fitted in the shaft-supporting brackets 9. The shaft-supporting brackets 9 are slidably fitted together with coil springs 52 in guide grooves formed in the fixed, upper and lower brackets 26,27, respectively. Normally, the shaft-supporting brackets 9 are resiliently biased toward ends of the corresponding guide grooves 11.

Via the shaft-supporting brackets 9, shafts 35,36 and sleeves 34, the take-up shaft 6 itself is also biased towards the interior by the coil springs 52. Through the torsion spring 37 which is arranged within the take-up shaft 6, the shaft 35 extends. The torsion spring 37 is held at one end (37') thereof in a split end 38 of the shaft 35 and at an opposite end (37") thereof in a slit 39 formed in the take-up shaft 6, whereby resilient force produced by the torsion spring 37 is surely transmitted to the take-up shaft 6.

As the rolling screen 1 according to the second embodiment of the present invention is provided with the above-described construction, drawing of the screen case 25, which is slidably held between the upper and lower guide rails 23,24, in a horizontal direction can wind out the screen 5 from the screen case 25 while causing the take-up shaft 6 to rotate. The screen 5 is biased toward the interior by the resilient force of the helical springs 52, so that the fasteners 28 engage mesh openings of the screen 5. The screen 5 is therefore fixed at the side, namely, upper and lower edges thereof owing to their engagement with the corresponding fasteners 28 and also at the opposite vertical end edges thereof by the take-up shaft 6 and the angle 4, respectively. The screen 5 can therefore be firmly arranged in an extended state without any slack.

Figure 8:
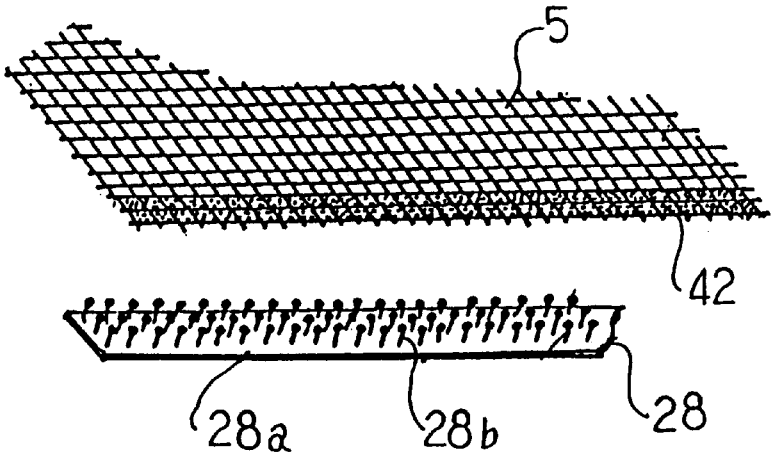
FIG. 8 is a fragmentary perspective view of a net and a fastener useful in the present invention.
Figure 9:
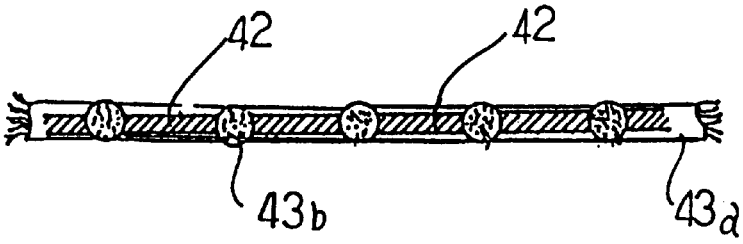
FIG. 9 is a fragmentary cross-sectional view of the net useful in the present invention.

FIG. 8 illustrates the flexible net which is employed as the screen 5 in the rolling screen 1 according to the second embodiment of the present invention. This flexible net has been reinforced at a predetermined width in opposite, upper and lower edge portions thereof, which extend at right angles relative to the take-up shaft 6, by coating the flexible net in the opposite, upper and lower edge portions thereof with a liquid-form synthetic resin to form thin films 42 in the mesh openings and then hardening said thin films under heat to cover the opposite, upper and lower edge portions of the net with the synthetic resin. The flexible net is generally in the form of a mesh available by raschel knitting or tricot knitting of polyester warp and weft yarns. In this case, the warp and weft yarns are rather resistant to loosening. As the time goes on, the warp and weft yarns in the opposite edge portions of the net, i.e., the screen 5 however becomes more liable to loosening due to deterioration with age. If this happens, the warp and weft yarns so loosened twine around the fasteners 28 so that the smooth engagement and disengagement of the screen 5 are hampered. By reinforcing the opposite edge portions of the screen 5 as described above, it is possible to prevent the warp and weft yarns of the screen 5 from becoming loose due to deterioration with age and twining around the fasteners 28. Unlike the conventional reinforcement of the screen 5 by bonding reinforcing tapes, the above-described reinforcement does not result in an enlargement of the outer diameter of the take-up shaft 6, including the screen 5 wound thereon, so that the rolling screen 1 according to the second embodiment of the present invention has wide applicability (see FIG. 9). It is to be noted that the above-described hardening of the synthetic resin does not always require heat treatment and can be effected without heating insofar as the synthetic resin hardens in an appropriate time.

Figure 10:
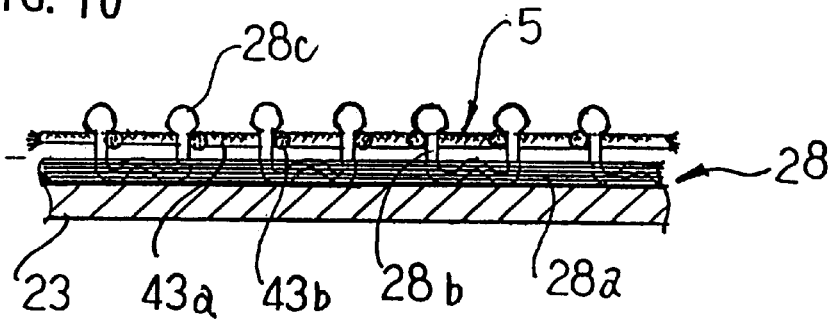
FIG. 10 is an enlarged fragmentary cross-sectional view of the net and the fastener useful in the present invention as viewed in an engaged state.

The net-shaped flexible screen 5, which is employed in the rolling screen 1 according to the second embodiment of the present invention, is brought into engagement, as is depicted in FIG. 10, with the upper fastener 28 on a lower side of the upper thin film 42 and also with the lower fastener 28 on an upper side of the lower thin film 42. Each fastener 28 is composed of hoops 28*a* and synthetic resin bristles 28*b* implanted in the hoops 28*a*. Each synthetic resin bristle 28*b* terminates in a grip 28*c* having a larger diameter than the bristle 28*b*. When the take-up shaft 6 rolls over the fasteners 28 with the net-shaped flexible screen 5 interposed therebetween, the net-shaped flexible screen 5 is pressed against the fasteners 28 so that the grips 28*c* formed at the free ends of the synthetic resin bristles 28*b* enter the mesh openings of the screen 5. As a consequence, the bristles 28*b* are hooked on the warp yarns 43*a* and the weft yarns 43*b* of the screen 5. In this manner, the net-shaped flexible screen 5 is held in place owing to the engagement of the opposite, upper and lower edge portions thereof with the corresponding fasteners 29. Even if external pressure such as wind pressure applies to the screen 5 and pulling force hence applies to the warp and weft yarns, a majority of the pulling force acts as shearing force on the synthetic resin bristles 28*b* of the fasteners 28 maintained in engagement with the opposite, upper and lower edge portions of the screen 5 because the pulling force acts as pulling force toward a central part of the screen 5. The screen 5 is therefore not readily separated from the fasteners 5. The screen 5 is hence firmly arranged extending tautly. Even if the screen 5 is separated from the fasteners 28, the screen 5 can be brought back into engagement with the fasteners 28 by once winding up the screen 5 on the take-up shaft 6 and then arranging the screen 5 again in an extended state.

Figure 11:
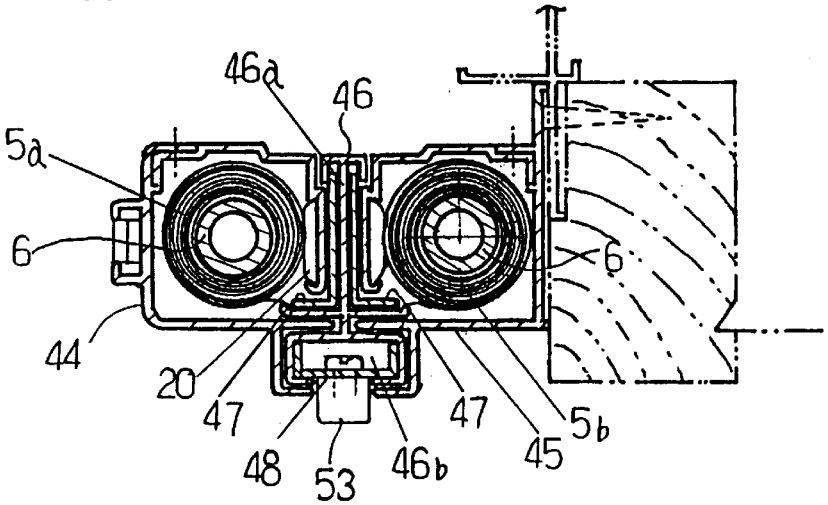
FIG. 11 is a fragmentary horizontal cross-sectional view of a rolling screen according to a third embodiment of the present invention as viewed in an installed state.

With reference to FIG. 11, the rolling screen 1 according to the third embodiment of the present invention will next be described. To permit alternative exhibition of a sunshade or blinding function or an insect-preventing function, the rolling screen 1 is provided with two screen cases 44,45 arranged side by side. The screen case 44 accommodates therein a take-up shaft 6 with a sunshade screen 5*a* wound thereon for sunshade or blinding purposes, while the screen case 45 accommodates therein a take-up shaft 6 with a net-shaped screen 5*b* wound thereon for preventing entry of insects. Upper and lower end portions of the screen cases 44,45 are maintained in slidable engagement with common upper and lower guide rails. The rolling screen 1 can be used to alternatively exhibit a screen function for insect-preventing purposes or a sunshade or blinding function as needed.

Figure 12:
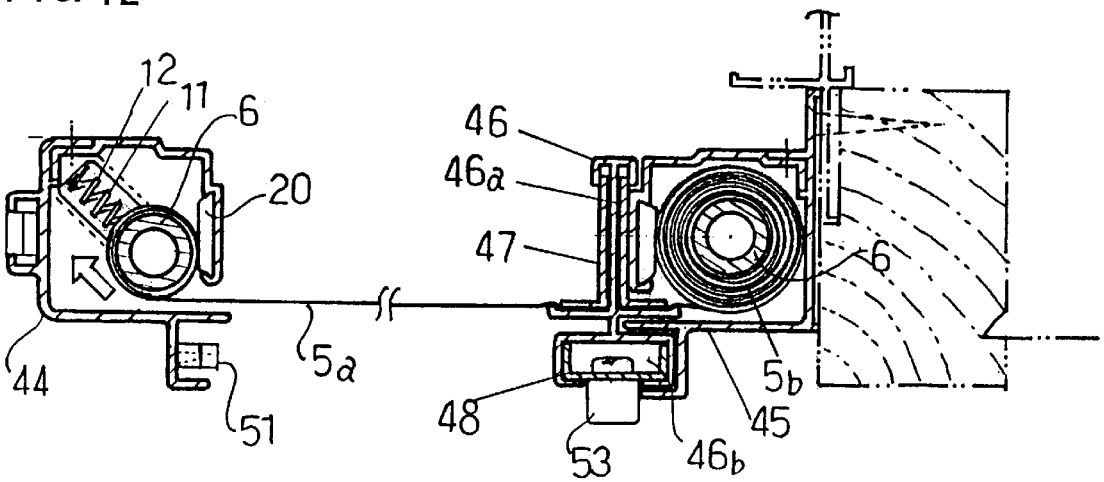
FIG. 12 is a fragmentary horizontal cross-sectional view of the rolling screen according to the third embodiment of the present invention as viewed upon arrangement of a sunshade cloth in an extended state.
Figure 13:
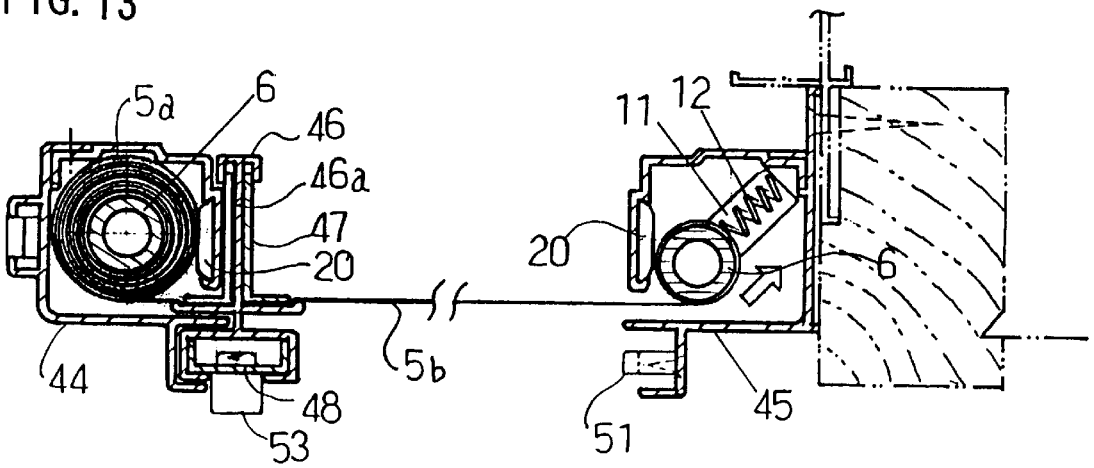
FIG. 13 is a fragmentary horizontal cross-sectional view of the rolling screen according to the third embodiment of the present invention as viewed upon arrangement of a net in an extended state.

Operation of the rolling screen 1 according to the third embodiment of the present invention will now be described with reference to FIG. 12. The screen cases 44,45 are arranged side by side, and are in detachable engagement with a selector 46 at opposite sides thereof. When its sunshade or blinding function is needed, the screen case 44 is drawn horizontally while maintaining the selector 46 in engagement with the screen case 45. As a consequence, the sunshade screen 5*a* is pulled out of the screen case 44 and is arranged in an extended state. When its function as a net for the prevention of entry of insects is needed, on the other hand, the screen case 44 is drawn horizontally while maintaining the selector 46 in engagement with the screen case 44, as is illustrated in FIG. 13. As a consequence, the net-shaped screen 5*b* is pulled out of the screen case 45 and is arranged in an extended state. Incidentally, free end edges of the screens 5*a*,5*b* are joined to corresponding angles 47,47 by using double-tack tapes or the like. These angles 47,47 are fixed on opposite sides of a web portion 46*a* of the selector 46.

Figure 14:
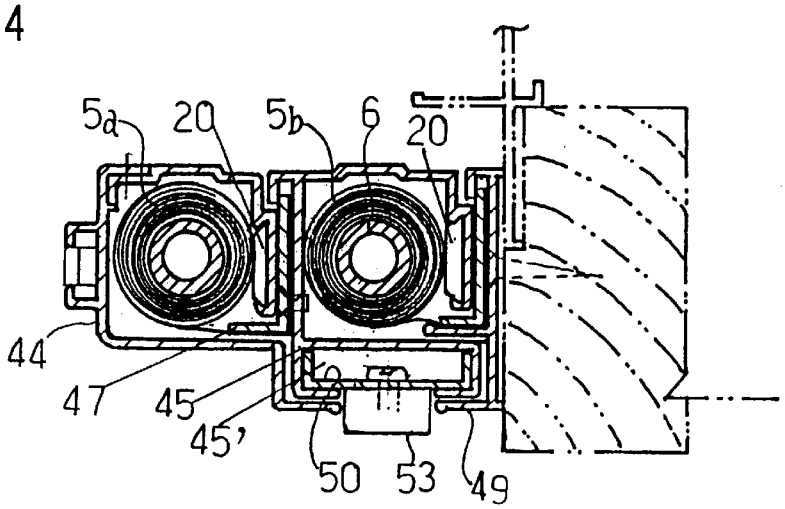
FIG. 14 is a fragmentary horizontal cross-sectional view of a rolling screen according to a modification of the third embodiment of the present invention as viewed in an installed state.

FIG. 14 illustrates the rolling screen 1 according to the modification of the third embodiment of the present invention. Two screen cases 44,45 are arranged side by side. The screen case 44 accommodates therein a take-up shaft 6 with a sunshade screen 5*a* wound thereon for sunshade or blinding purposes, while the screen case 45 accommodates therein a take-up shaft 6 with a net-shaped screen 5*b* wound thereon for preventing entry of insects. The sunshade screen 5, which is wound on the take-up shaft 6 accommodated within the screen case 44, is fixed at a free end edge thereof on an angle 47, and the angle 47 is in turn fixed on a side wall of the screen case 45 in which the other take-up shaft 6 is accommodated with the net-shaped screen 5*b* wound thereon. The net-shaped screen 5*b* is also fixed at a free end edge thereof on another angle 47 by a double-tack tape or the like. The another angle 47 is in turn fixed on a fixing member 49 which constitutes a jamb of an opening. Further, a lipped guide channel 45' is formed on a front wall of the screen case 45, and a slide bar 50 is fitted movably up and down in the lipped guide channel 45. Hooks 51 are fixed on the screen case 44 and the fixing member 49 so that holes 54 (see FIG. 17) formed in the slide bar 50 can be selectively brought into or out of engagement with corresponding holes 54 by operating the slide bar 50 upwards or downwards.

Figure 15:
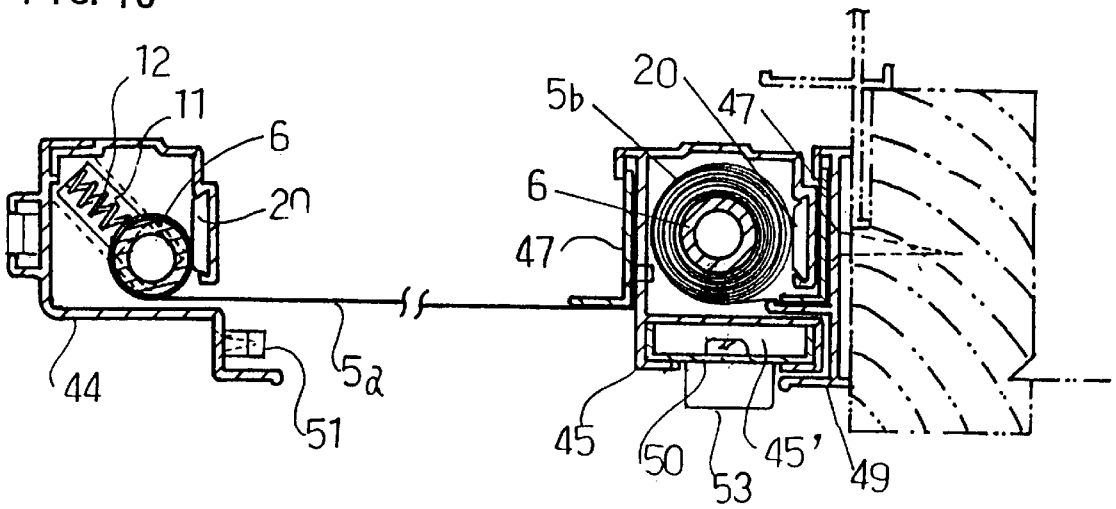
FIG. 15 is a fragmentary horizontal cross-sectional view of the rolling screen according to the modification of the third embodiment of the present invention as viewed upon arrangement of a sunshade cloth in an extended state.
Figure 16:
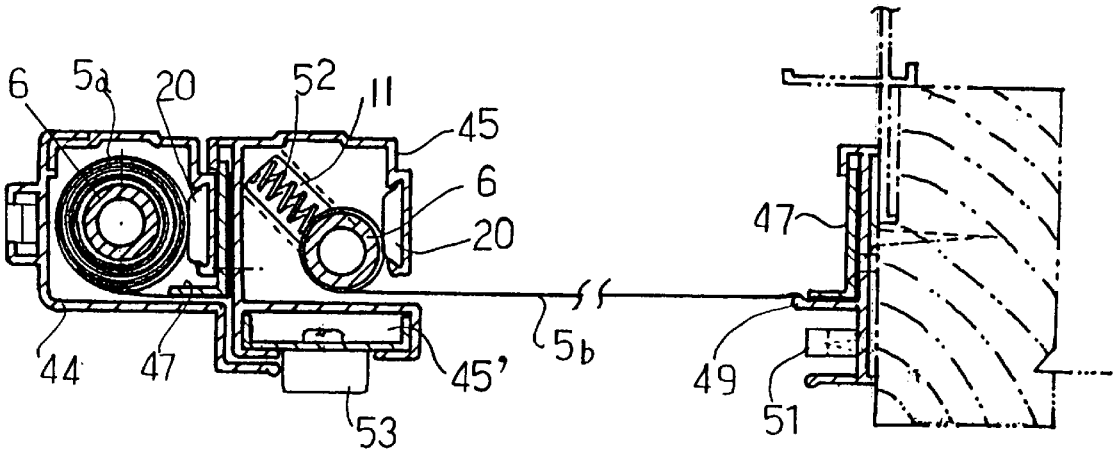
FIG. 16 is a fragmentary horizontal cross-sectional view of the rolling screen according to the modification of the third embodiment of the present invention as viewed upon arrangement of a net in an extended state.

Reference is next had to FIG. 15. The sunshade screen 5*a* is wound out and arranged in an extended state by operating the slide bar 50 upwards or downwards to bring the screen case 45 alone into engagement with the fixing member 49 and then drawing the screen case 44 horizontally. When it is desired to arranged the net-shaped screen 5*b* in an extended state, the slide bar 50 is operated to bring the screen cases 44,45 into mutual engagement and at the same time, to release the engagement between the screen case 45 and the fixing member 49, and the screen case 45 is drawn horizontally (see FIG. 16). Incidentally, when the sunshade screen 5*a* is arranged in an extended state, the upper and lower edges of the screen 5*a* are left free like as in the case of the rolling screen 1 shown in FIG. 12. When the net-shaped screen 5*b* is arranged in an extended state, the upper and lower edges of the screen 5*b* are fixed by their engagement with corresponding fasteners 28 as illustrated in FIG. 6.

Figure 17:
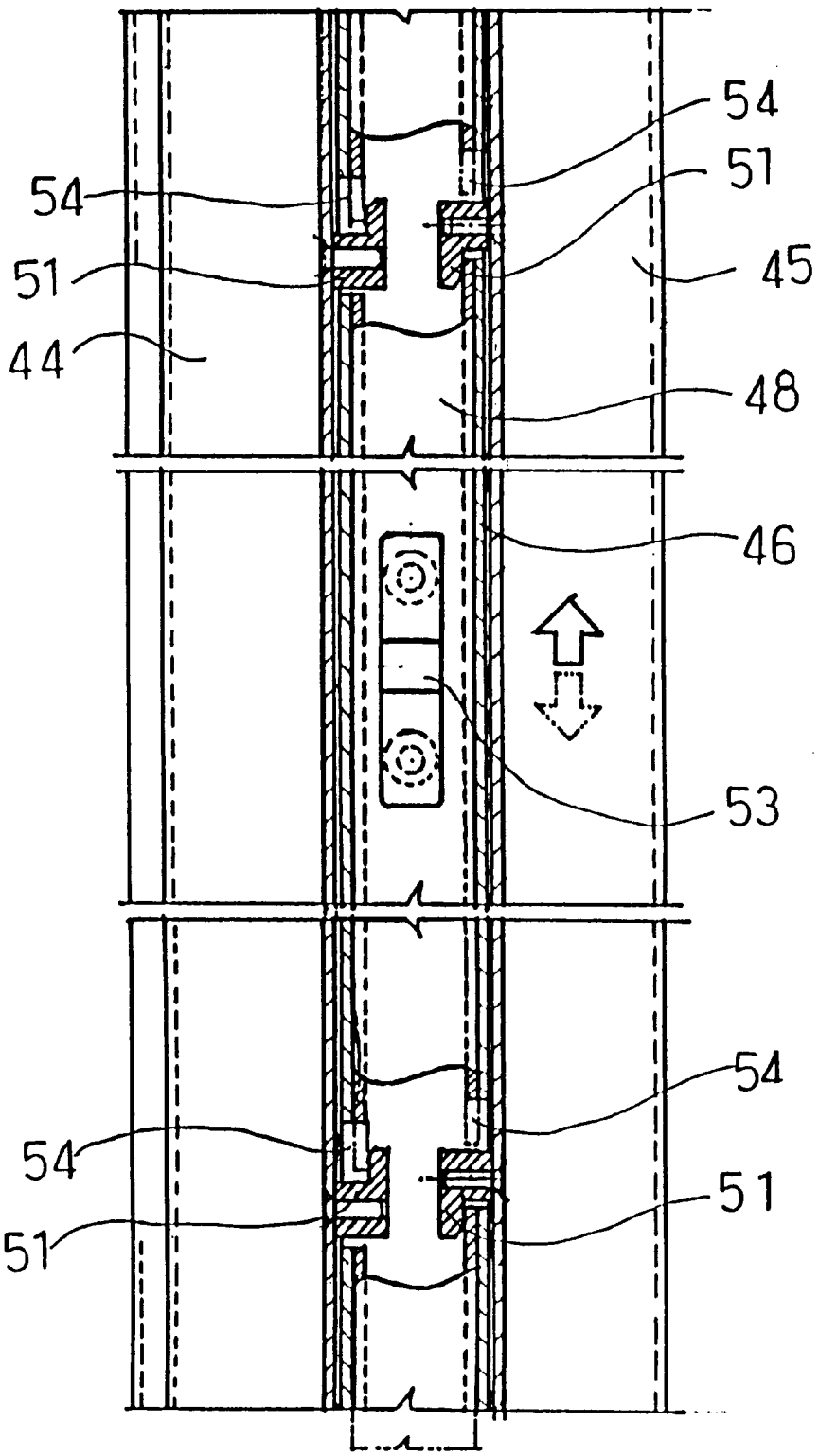
FIG. 17 is a partially cross-sectional, front view showing a selector in FIG. 11.

FIG. 17 illustrates the locking mechanism of the selector 46, which selectively locks and fixes the screen cases 44,45. A slide bar 48 which is in the form of a square U-shaped channel is fitted movably up and down in a guide channel 46*b* (see FIG. 11) formed on a flange portion of the selector 46. Holes 54 are formed in side walls of the guide channel 46*b*, respectively. A finger grip 53 is fixed on the slide bar 48 to facilitate upward and downward operation of the slide bar 48. Free arms of the hooks 51 on the screen case 44 extend upwards, while those of the hooks 51 on the screen case 45 extend downwards. When the slide bar 48 is operated downwards, the holes 54 in the left-hand side wall of the guide channel 46*b* (as viewed in FIG. 17) are brought into engagement with the corresponding hooks 51 on the screen case 44 and at the same time, the holes 54 in the right-hand side wall of the guide channel 46*b* (also as viewed in FIG. 16) are brought out of engagement with the corresponding hooks 51 on the screen case 45. When the slide bar 48 is operated upwards, on the other hand, the holes 54 in the left-hand side wall of the guide channel 46*b* are brought out of engagement with the corresponding hooks 51 on the screen case 44 and at the same time, the holes 54 in the right-hand side wall of the guide channel 46*b* are brought into engagement with the corresponding hooks 51 on the screen case 45. In other words, the hooks 51 on the screen case 44 and those on the screen case 45 are alternatively brought into engagement with the corresponding side walls of the slide bar 48.

What is claimed is:

1. A rolling screen adapted to be disposed either horizontally or vertically across an opening of a building, comprising:

a screen case;

a small-diameter flexible take-up shaft arranged rotatably about a central axis thereof within said screen case, said take-up shaft being normally biased in a screen-winding direction by a torsion spring;

a screen wound on said take-up shaft so that said screen can be wound out of said screen case through an opening therein, said screen wound on said take-up shaft having an outer peripheral surface; and a pair of opposed parallel guide rails adapted to be arranged along casings which are disposed across said opening of said building such that said screen case with said take-up shaft accommodated therein is movable along said guide rails and guided at opposite end portions of said screen case by said guide rails;

wherein said outer peripheral surface of said screen wound on said take-up shaft is always maintained in contact, substantially throughout its width, with an inner wall of said screen case disposed adjacent said opening thereof, a portion of said inner wall in contact with said surface being spaced from said screen at a point at which said screen leaves said shaft said contact being maintained by a pulling force applied to said screen upon extenston of said screen when said screen is extended.

2. A rolling screen according to claim 1, wherein an entirety of the width of said screen is maintained in contact with said inner wall of said screen case.

3. A rolling screen according to claim 1, wherein said take-up shaft is supported by shaft supporting brackets movably fitted in guide grooves of guide brackets fixedly arranged on the screen case.

4. A rolling screen according to claim 3, wherein a feedback spring is secured on the shaft supporting brackets.

5. A rolling screen according to claim 1, wherein said screen is a flexible net, said flexible net having reinforced side edge portions which are thin films of hardened synthetic resin.

6. A rolling screen according to claim 1, further comprising:

guide rails arranged in parallel with each other at opposite end portions of said screen case; and a fastener arranged on each of said guide rails, respectively, each of said fasteners comprising a plurality of bristles which are detachably engageable with said screen, said fasteners being arranged such that said bristles detachably engage said side edge portions of the flexible net which are reinforced with said thin film of synthetic resin.

7. A rolling screen according to claim 1, wherein said screen case comprises at least two integral adjacent walls and is adapted to be mounted on a wall and said opening of said screen case is located in one of said walls near a corner where two of said walls meet, whereby when said screen is wound out of said screen case, said take-up shaft with said screen wound thereon to move diagonally toward said corner thereby causing said outer peripheral surface of said screen wound on said take-up shaft to be always maintained in contact with said inner wall disposed adjacent said opening of said screen case.

8. A rolling screen adapted to be disposed either horizontally or vertically across an opening of a building comprising:

a screen case;

a small-diameter flexible take-up shaft arranged rotatably about a central axis thereof within said screen case;

a flexible net wound as a screen on said take-up shaft so that said flexible net can be wound out of said screen case;

a pair of opposed parallel guide rails adapted to be arranged along casings which are disposed across an opening of a building such that said screen case with said take-up shaft accommodated therein is movable along said guide rails and guided at opposite end portions of said screen case by said guide rails; and fasteners arranged on said guide rails, respectively, each of said fasteners comprising a plurality of bristles that are detachably engageable with said screen wherein said flexible net has reinforced side edge portions which are thin films of hardened synthetic resin, said bristles engaging openings in the flexible net at said reinforced side edge portions;

wherein, when said screen case is caused to move in a direction along said guide rails, said flexible net is adapted to extend over said opening of said building without slack by causing a wound-out portion of said flexible net to detachably engage said fasteners at opposite side edge portions of said flexible net and, when said screen case is caused to move in an opposite direction along said guide rails, said flexible net is wound into said screen case by taking up said flexible net on said take-up shaft while allowing said opposite side edge portions of said wound-out portion of said flexible net to disengage from said fasteners.

9. A rolling screen comprising:

guide rails arranged in parallel with each other along casings, which are adopted to be disposed in a paired opposing relationship across an opening of a building, respectively, two screen cases arranged so that said two screen cases are guided at opposite ends thereof by said guide rails, take-up shafts arranged rotatably within said screen cases, respectively, one of said take-up shafts carrying a sunshade screen wound thereon and the other one of said take-up shafts carrying a flexible net wound thereon, and a selector arranged between said screen cases so that said screen cases can be selectively connected together or disconnected from each other;

whereby one of said sunshade screen and said flexible net can be arranged extending over said opening as desired.

10. A rolling screen according to claim 9, wherein said flexible net has reinforced side edge portions which are thin films of hardened synthetic resin.

11. A rolling screen adapted to be disposed either horizontally or vertically across an opening of a building, comprising:

a screen case;

a small-diameter flexible take-up shaft arranged rotatably about a central axis thereof within said screen case, said take-up shaft being normally biased in a screen-winding direction by a torsion spring;

a screen wound on said take-up shaft so that said screen can be wound out of said screen case through an opening therein, said screen wound on said make-up shaft having an outer peripheral surface; and a pair of opposed parallel guide rails adapted to be arranged along casings which are disposed across said opening of said building such that said screen case with said take-up shaft accommodated therein is movable along said guide rails and guided at opposite end portions of said screen case by said guide rails;

wherein said outer peripheral surface of said screen wound on said take-up shaft is always maintained in contact, substantially throughout its width, with an inner wall of said screen case disposed adjacent said opening thereof, a portion of said inner wall in contact with said surface being spaced from said screen at a point at which said screen leaves said shaft, said contact being maintained by a resilient force of a pressing spring when said screen extended or wound in.

12. A rolling screen according to claim 11, wherein an entirety of the width of said screen is maintained in contact with said inner wall of said screen case.

13. A rolling screen according to claim 11, wherein said take-up shaft is supported by shaft supporting brackets movably fitted in guide grooves of guide brackets fixedly arranged on the screen case.

14. A rolling screen according to claim 13, wherein said pressing spring is secured on the shaft supporting brackets.

15. A rolling screen according to claim 11, wherein said screen is a flexible net, said flexible net having reinforced side edge portions which are thin films of hardened synthetic resin.

16. A rolling screen according to claim 11, further comprising:

guide rails arranged in parallel with each other at opposite end portions of said screen case; and a fastener arranged on each of said guide rails, respectively, each of said fasteners comprising a plurality of bristles which are detachably engageable with said screen, said fasteners being arranged such that said bristles detachably engage said side edge portions of the flexible net which are reinforced with said thin film of synthetic resin.

* * * * *